US009295992B2

(12) United States Patent
Zickell

(10) Patent No.: US 9,295,992 B2
(45) Date of Patent: Mar. 29, 2016

(54) HORIZONTAL MIXER

(71) Applicant: Recycled Asphalt Shingle Technology, Brentwood, NH (US)

(72) Inventor: Thomas J. Zickell, New Castle, NH (US)

(73) Assignee: Recycled Asphalt Shingle Technology, LLC, Brentwood, NH (US)

( * ) Notice: Subject to any disclaimer, the term of this patent is extended or adjusted under 35 U.S.C. 154(b) by 0 days.

(21) Appl. No.: 13/915,825

(22) Filed: Jun. 12, 2013

(65) Prior Publication Data

US 2014/0097278 A1 Apr. 10, 2014

Related U.S. Application Data

(60) Provisional application No. 61/659,127, filed on Jun. 13, 2012.

(51) Int. Cl.

| | |
|---|---|
| ***B02C 19/00*** | (2006.01) |
| ***E01C 19/05*** | (2006.01) |
| ***E01C 19/10*** | (2006.01) |
| ***B02C 23/08*** | (2006.01) |
| ***B02C 19/18*** | (2006.01) |

(52) U.S. Cl.

CPC ..... *B02C 19/0056* (2013.01); *B02C 19/186* (2013.01); *B02C 23/08* (2013.01); *E01C 19/05* (2013.01); *E01C 19/1004* (2013.01)

(58) Field of Classification Search

CPC ..... B02C 13/02; B02C 13/04; B02C 13/06; B02C 13/10; B02C 2201/02; B02C 19/186; B02C 19/08; B02C 19/05; B02C 23/08; E01C 19/0056; E01C 19/1004

USPC ..... 241/23, 35, 79.1, 65, 260.1

See application file for complete search history.

(56) References Cited

U.S. PATENT DOCUMENTS

| | | | | | |
|---|---|---|---|---|---|
| 3,661,330 | A * | 5/1972 | Yamada et al. | 241/65 | |
| 3,756,518 | A * | 9/1973 | Bailey | 241/65 | |
| 4,702,426 | A * | 10/1987 | Citterio | B02C 13/2804 | 241/167 |
| 4,720,254 | A * | 1/1988 | Wood | B29C 47/605 | 241/260.1 |
| 4,993,649 | A * | 2/1991 | Koenig | B02C 19/22 | 241/224 |
| 5,108,040 | A * | 4/1992 | Koenig | B30B 11/246 | 241/260.1 |
| 5,156,794 | A * | 10/1992 | Nakanishi et al. | 264/349 | |
| 5,188,299 | A * | 2/1993 | Hendrickson et al. | 241/23 | |
| 5,409,541 | A * | 4/1995 | Walker | 127/2 | |
| 5,673,861 | A * | 10/1997 | Miller | A61L 11/00 | 241/163 |
| 5,704,555 | A * | 1/1998 | Arastoopour | B29B 13/10 | 241/16 |
| 5,743,471 | A * | 4/1998 | Ivanov | B29B 13/10 | 241/16 |
| 5,848,755 | A * | 12/1998 | Zickell | B02C 17/04 | 241/171 |
| 6,357,682 | B1 * | 3/2002 | Hext | B02C 18/141 | 241/161 |
| 6,505,550 | B2 * | 1/2003 | Hamilton | B30B 9/3025 | 100/148 |

(Continued)

*Primary Examiner* — Faye Francis

(57) ABSTRACT

A system (10) for recycling asphalt shingle scrap. There is a cold process, hot process, and a separation process. In the hot process, all of the components are ground except for the course surface granules. In the cold process, a type of grind is formed that is the same as the hot process except it is a dry powder. A horizontal mixer (20) can be used either hot or cold. The hot process and cold process can be run in combination with one another or independently. The component separation process uses a screen or the like (34) to separate the cold process material into surface granules, filled asphalt coating, and saturated felt component, while a magnet (38) may be used to help separate nails and other metal objects from the mixture.

4 Claims, 2 Drawing Sheets

(56) References Cited

U.S. PATENT DOCUMENTS 6,513,737 B2 * 2/2003 Ivanov ..... B29B 17/0404 241/23
7,028,932 B2 * 4/2006 Lucas ..... A01K 5/002 241/101.8
7,635,460 B2 * 12/2009 Carrasco ..... 423/571
7,913,940 B2 * 3/2011 Harmon ..... 241/21
8,157,193 B2 * 4/2012 Avant et al. ..... 241/14
8,544,777 B2 * 10/2013 Tsai ..... B29B 17/0026 241/260.1
2001/0017328 A1 * 8/2001 Hamilton ..... B30B 9/3025 241/260.1
2010/0064937 A1 * 3/2010 Harmon et al. ..... 106/273.1
2013/0008986 A1 * 1/2013 Zickell et al. ..... 241/19

* cited by examiner

HORIZONTAL MIXER

CROSS-REFERENCE TO RELATED APPLICATIONS

This application claims priority from U.S. Provisional Patent Application No. 61/659,127 entitled "Horizontal Mixer", filed on Jun. 13, 2012 which is incorporated fully herein by reference.

TECHNICAL FIELD

The present invention relates to roofing shingle recycling processes, products, and associated apparatus, and more particularly, relates to the system of converting/recycling new and used asphalt shingle scrap into multiple asphalt-based products.

BACKGROUND INFORMATION

In the United States, approximately 10 to 11 million tons of old asphalt shingle roofing ("tear-offs") is removed from existing building each year, and about 1.0 million tons of factory rejects and tab cut-outs ("factory scrap") are generated each year. The exact composition of a particular roofing shingle depends on the manufacturer and the roofing application, but the shingle manufacturing process is similar in each instance.

The shingle manufacturing process begins with a layer of organic (cellulose or wood fiber) or fiberglass backing felt. The felt is impregnated with liquid asphalt, then coated on both sides with additional asphalt. The asphalt used as the saturant is of a different type than the asphalt used as the coating, but both are harder than asphalt generally used in pavement. Both types of asphalt are "air-blown", or bubbled, during production, a process that incorporates oxygen into the asphalt and further increases the viscosity. Powdered limestone (70% passing the No. 200 sieve) is also added to both types of asphalt as a stabilizer.

Once coated with the appropriate thickness of asphalt, one side of the shingle is then surfaced with granules for protection against physical damage, and damage from ultraviolet rays of the sun. The granules which are exposed in the roofing application are comprised crushed rock coated with ceramic metal oxides, and the headlap granules are coal slag. Both types of aggregate are relatively uniform is size, most ranging from 0.3-2.36 mm, and both are hard and angular.

Finally, a light coating of fine sand (<0.425 mm) is applied to the back surface to prevent the individual shingles from adhering to each other during packaging and transport.

There has been a significant interest in and development of several systems and methods for recycling both new and used asphalt roofing shingles, and for using the recycled material in hot and cold paving compositions. To date, however, none of these prior art system and methods have resulted in an economically and technically viable solution.

For example, currently one methodology and system utilizes a 400 hp grinder is used to chip shingles into ⅜ inch pieces at ambient temperatures so that the pieces can be used in asphalt for roads. However, this process consumes a tremendous amount of energy and is environmentally unfriendly (emitting large quantities of dust). The material produced is unsuitable to most paving companies because all of the nails are not removed, the size of the material is so large that little of the "asphalt" value in the roofing shingles is released to be used for asphalt in the paving composition, and the shingles are inconsistent containing unknown amounts of fiberglass and organic shingles mixed together.

Another problem with the current chipped shingles used in paving compositions is that paving companies do not want plastic film previously on the back of the shingles to show up in the finished road.

In the paving market, the "fines" from recycled asphalt such as asphalt shingles are a huge problem. Fines are defined as particles that are 200 mesh or smaller. The fines wash the aggregate before it is introduced into the road mix. If there is too high of a level of fines, it causes over-compaction of the road surface. It is preferred that a certain amount of air "voids" are in the mix. Fines are undesirable because they decrease voids and the voids are necessary for compaction and road longevity. The fines also create problems with the roller procedure and cause over compaction, which may cause premature failure of the road.

Road asphalt producers are typically concerned with "rock dust." If crushed rock from the roofing shingles is used as filler in asphalt based road material, it can cause cracking and ultimately product failure. The paving industry experienced wide spread failure due to this problem. This has also been a barrier to recycling technologies that crush the granules.

Accordingly, what is needed is and asphalt shingle recycling system and method which addresses the problems currently found in the prior art systems. The system should have a lower energy usage, such as 140 hp motor rather than the high energy usage of 400-500 hp currently seen in systems. The system should be environmentally friendly, reducing or eliminating the clouds of dust that are emitted into the atmosphere from prior art systems and additionally should remove all nails and also remove the reinforcing component of the shingle (fiberglass or cellulose) in order to achieve consistency in the milling process. The present invention addresses all of the issues currently found in prior art systems.

SUMMARY

The present invention is a system, process, and device for recycling both new and used asphalt shingle scrap into a material with various industrial uses. There is a cold process, hot process, and a separation process within the entire system. A horizontal mixer can be user either hot or cold. Each process can be done separately or in combination with another process. For example, only the cold process output is used for paving compositions. In the hot process, shingles are ground together with liquid addition. During the hot process, all of the single components are ground except for the course surface granules. The granules are left intact in order to produce a product suitable for use in paving. In the cold process, a type of grind is formed that is the same as the hot process except it is a dry powder. The component separation process differentiates the cold process material into surface granules, filled asphalt coating, and saturated felt component of organic shingles.

The process of the present invention exploits the fact that roof shingles become brittle and frangible in cold temperatures and soft with little tensile strength at high temperatures. Therefore, the net effect is that much less energy is consumed in the present process and it is cleanly operated. The present invention also maximizes the recovery and use of usable asphalt content found in the roofing shingles.

The present invention turns the shingles into dust (cold process) and softens/disperses the plastic (hot process) so that the plastic tape is removed from the shingles and or processed into unrecognizable pieces.

The present invention also includes a cold process that reduces this problem because the granules are left intact; the fiber content adds a tangible benefit for crack resistance and deformation due to the wheel pressure in hot weather. The present system and method also eliminates the problem of rock dust and granules entirely by separating the granules (source of the rock and "rock dust") from the rest of the recycled mixture.

These and other features and advantages of the present invention will be better understood by reading the following detailed description, taken together with the drawings wherein.

DETAILED DESCRIPTION OF THE PREFERRED EMBODIMENTS

Figure 1A:
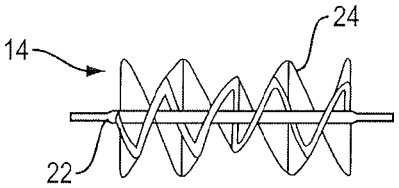
FIGS. 1-1E are schematic diagrams of a horizontal cold and hot asphalt material recycling system according to the present invention.
Figure 1B:
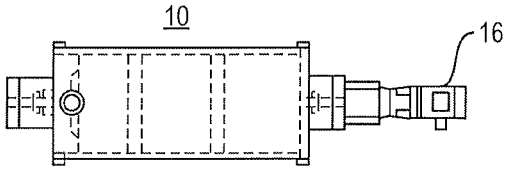
Figure 1C:
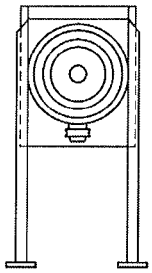
Figure 1D:
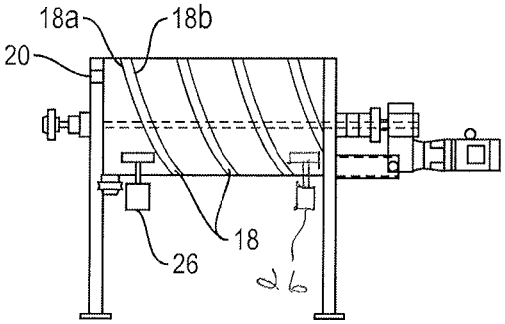
Figure 1E:
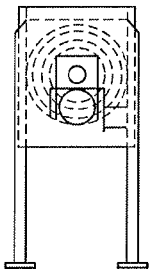
Figure 1E:
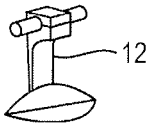

Energy embedded in the asphalt shingles can be recaptured in the process of recycling. The present invention is a system and method for recycling asphalt shingles to be used as materials in various industries. This process can be run in a cryogenic, ambient, or heated system to create various products. The system includes a horizontal mixer 10, FIGS. 1A-1E, having choppers and/or agitators 6, a ribbon assembly 14 and uses typically approximately a 140 or less hp motor 16. The mixer 10 has alternating coils 18 on the outside of the unit: one set 18*a* for hot and the other set 18*b* for cold. The horizontal mixer 10 can be used either hot or cold or in a combination of the two processes.

The preferred machine has a horizontal cylinder shaped body 20 and has a horizontal shaft 22 with a ribbon type blender 24. The ribbon blender 24 conveys material into the one or more choppers 26 in order to reduce the size of the material particles to a dust substance. These choppers 26 run at high RPMs (revolutions per minute) and have short, blunt blades. The mixer may be used in construction sites; therefore, it is especially durable to standard wear.

The present invention preferably breaks up shingles to different sizes without breaking up the surfacing granules. Organic shingles contain about 10-15 percent fines as fillers and fiberglass reinforced shingles contain about 30-35 percent fines. The granules are 16 mesh size, typically 35 percent of the shingle composition, and are not considered "fines."

There is a cold process and a hot process within the entire system. These processes exploit two main properties of shingles. When the shingle is hot, surface coating melts off and reinforcing felt or glass mat completely lose strength. When the shingle is cold, they are brittle and have little structural integrity.

In the hot process, the machine accepts post factory bundles or post consumer shingles, mixes them with hot asphalt (and/or other rejuvenating additives) and grinds the mix to a level where only the surface granules of the shingles remain un-ground. It breaks the shingles up into pieces smaller than 16 mesh allowing for full use of the asphalt credit (amount of voids to be filled with asphalt compared with the size of the grind). During the hot process, all of the single components are ground except for the course surface granules. This grind has a particle size that may be favored by the paving and cold patch industries.

The horizontal mixer 10 can also be run in a hot process by running hot oil through the jacket coils 18. While the granules are not removed, the resultant material has valuable uses where the presence of granules will not result in a problem. The hot process exploits that fact that hot shingles (any amount of warmth reduces the strength, but the preferred temperature is over 240 F) have very low tensile and tear strength because the asphalt creates much of the strength.

The output of the cold process creates a dust-like material with the largest component being the 16 mesh granules. This type of grind formed is the same as the hot process except it is cryogenic. To reach a desired temperature, an amount of chilled fluid is run through the jacket coils 18 of the machine and liquid nitrogen may be added into the machine itself. The cold material has the advantage of ease of transportation and no capital requirement for the end user. Therefore, the material may be easily stored (outside in piles) until needed and can be transported in dump trucks or in vans or flatbed trucks in tote bins or supersacks. In this form, the cold system can also be used in most contemporary paving plant systems that handle Reproduced Asphalt Paving (RAP). The cold grind may require more energy than hot grind, but energy savings in storage and transportation offsets it.

Raw materials produced by the cold system may be used for paving and cold patch companies. The paving industry does not want the plastic that is on the back of all the shingles. Therefore, this process grinds the plastic to a powder form. Proposed federal specifications for use of shingles in roads relates to the particle size distribution of the grind to the amount of virgin asphalt that can be replaced. This process reduces the shingles to a powder (except surface granules) so that maximum asphalt value can be reclaimed.

The cold process exploits the fact that asphalt shingles are brittle when chilled. Once the shingles are introduced into the horizontal mixer they are chilled by adding dry ice (CO2) and/or circulating chilled liquid through the jacket coils 18 surrounding the vessel 20. A paddle or ribbon system 14 affixed to a horizontal shaft 22 feeds the shingles into "choppers" 26. The choppers are high speed (3000 RPMs) with a "T" shaped head, designed to both cut and bluntly impact the material. The preferred chopper has a flat impacting surface and a sharpened edge.

Asphalt shingles are produced using two types of reinforcement: fiberglass mat or cellulose fiber. Both are ribbon like "mats" that can be coated on the top and bottom surfaces with a mixture of highly oxidized asphalt (210 F melt point) and mineral filler (this combination will be called "filled asphalt coating"). In the case of the cellulose reinforcement the material must be saturated with slightly oxidized asphalt (140 F melt point) whereas the fiberglass mat reinforced type need only be coated with the highly oxidized asphalt and filler mixture (filled asphalt coating). The top surface is then covered with colored granules and the back surface with sand. The cutting action is necessary to reduce the reinforcement, and the blunt impact action breaks the filled asphalt coating away from the reinforcement and separates the granules from the asphalt coating. The preferred mode of operation is continuous, but it may also be run as a batch. A fine mineral material such as 200 mesh limestone or talc may be added into the vessel to reduce sticking. Five percent by weight is preferred.

Figure 2A:
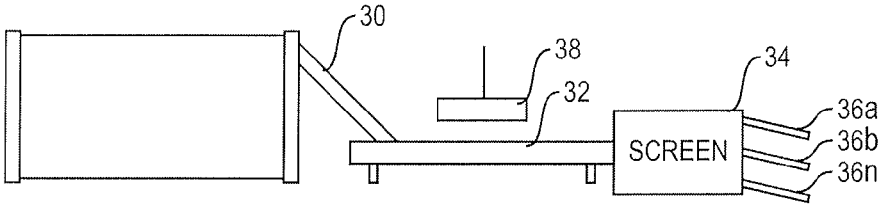
FIG. 2A is a schematic diagram of an exemplary conveyor and screener apparatus for use in the asphalt recycling system and method according to the preferred embodiment of the present invention of a cold process mixer.
Figure 2B:
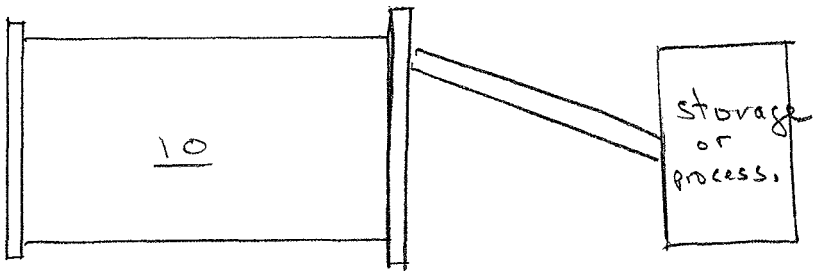
FIG. 2B is a schematic diagram of an exemplary asphalt recycling system and method according to the preferred embodiment of the present invention of a hot process mixer.

When the material leaves the vessel 30, FIG. 2, it is conveyed 32 to a vibrating screen 34 for separation by size 36*a*-36*n*. This step can also be accomplished using air separation. The granular surfacing material is partially coated with asphalt/filler (10-15% by weight) and is separated out on a 14 to 18 mesh screen. These granules can be cleaned and reused by the roofing industry or used (leaving the filled asphalt coating that is attached intact) in hot mix asphalt (HMA) for roads.

When the granules are used for hot mix asphalt (HMA), the prior art processes used scrap shingles in roads to feed the shingles into a 400 to 500 Hp Hammer Mill at ambient temperatures and chip them into ⅜ inch pieces. This process has several problems that are solved by present invention. The preferred invention uses a 100 to 140 hp motor, rather than 400-500 hp as is typical in prior art systems. High energy usage means a higher cost, which is avoided by the present invention. The present invention is also completely enclosed, which prevents the emission of clouds of dust into the atmosphere, which drastically improves on the environmental impact of the present invention over the prior art. Furthermore, prior art process have not allowed all nails to be completely removed. In the present invention, all nails are removed because both magnets 38 and screens 34 are utilized. The prior art hammer mill technology relies on only magnets that are not effective with nonferrous materials (aluminum nails have been broadly used).

Other problems of prior art systems that have been solved by the present invention include the following. The plastic tape on the back of shingles (to stop sticking while in the bundle form) cannot be removed in a "chipping operation" as found in prior art systems. In the present invention, the plastic is separated out on the screens of the screener 34. Presently, the industry that collects shingles cannot separate the two types (cellulose/fiberglass) because they may originate from the same roof from different layers or because they are comingled in the same collection stock pile. The grinding entity has no effective means to separate the shingle types, so they are milled together. The reinforcement types are very different, but the rest of the components are the same.

The fiberglass mat is 2.4 percent of the total shingle weight and the asphalt saturated cellulose mat is 18 percent. The fiberglass based shingles have half as much fiber by weight. The amount and types of fiber have a very significant effect of the rheology, viscosity and other properties of the HMA. The saturating asphalt also introduces another variable. Therefore, the present invention includes means to remove the reinforced component of the shingle (the only component that is different in the two shingle types) so that consistency may be achieved. The means for accomplishing removal of the reinforced component of the shingle includes removing the reinforcement, whether it is fiberglass or cellulose. Removal occurs because the reinforcement is tougher to break up so it can be classified by size. However, it could also be classified by density using air separation.

"Fines" are mineral particles 200 mesh or smaller. These small particles increase the viscosity of the HMA. If the viscosity gets too high it creates problems for the rolling operation because it takes more passes to "flatten" the mix. About 4 percent "voids" (open spaces in the finished road within the mix) are very desirable for road longevity. If the fines are too high the mix has too many voids, so the percentage of fines must be controlled and is a limiting factor in using scrap shingles. Fiberglass shingles have 34 percent fines and cellulose based shingles have 15 percent fines. Again, uncontrolled mixing of the shingle types will cause consistency problems in the HMA. Therefore ⅜ "chipped" shingle pieces that are created by prior art systems contain anywhere from 15 to 34 percent fines.

Asphalt coated granules from the present invention consistently contain 10 percent fines regardless of the type of reinforcement. This also means that a larger percentage by weight of granules can be used. The proportion of fines is fixed. ⅜ inch chips do not fully dissolve in the pug mill process used by the HMA industry. As a result, tests performed by the University of New Hampshire have shown that it takes 10 percent more virgin asphalt using ⅜ inch chips to get the same HMA properties as granules provided by the present invention.

The saturated felt or cellulose component can be removed by exploiting either the size differential from other component using screening or the density difference using air separation. An important reason that this is a very valuable component is that the saturating asphalt is only slightly oxidized (140 F MP) it is much closer in properties to flux asphalt (straight run, non-oxidized, 100 F MP) than the highly oxidized coating asphalt that is mixed with filler that coats the reinforcing mat and holds the granules and sand (230 F MP). This asphalt is also protected from UV rays because it is an internal component this preserves the original properties. After the granules and reinforcement are removed, the resulting material is a powder with 100 percent passing 40 mesh. A 40 mesh materials is similar in visual consistency to gun powder.

The importance of the achievement of creating a process where the granules are not ground up and part of the mix is a significant improvement over prior art systems for the asphalt shingle manufacturing industry. Over the last 20 years, the asphalt shingle manufacturing industry has been slowly converting from cellulose reinforced shingles to fiberglass. Either limestone or crushed rock has been used as the 200 mesh mineral material mixed with the highly oxidized asphalt as filler. Problems began surfacing with shingles tearing on roofs. The problem became so severe that Class Action suits were filed. It turned out that hard materials such as rock dust etched the glass fibers in the material and weakened the tensile/tear strength. Consequently, any prospective process aimed at recycling shingles must remove substantially all of the granules because they are made of trap or other hard rock. Any process that impacts the granules between two hard materials, as hammer mills do, will break the granules to the size of the filled coating asphalt and make separation impossible. The present invention impacts the shingles at a calibrated force so the granules are not broken.

A separate cold or ambient temperature process allows for the granules to be removed and the major components separated. The other components are reinforcement (fiberglass or organic) and filled asphalt coating (combination of filler and asphalt). This creates value because the component parts are worth much more separately than combined together. It also allows for much greater flexibility in formulations and increases the recycle content of the products.

After shingles are "pulped," the granules and other components can be separated with sieves, centrifuge and/or air classifiers. Air classifiers are especially well suited for separating the saturated felt component because the density is about half that of the other components. The saturated felt component can be separated by reducing the mix to the 16 mesh granules (largest component) or only reducing the shingle pieces to a size of ½ to 1 inch pieces. The latter may also be accomplished by varying the temperature and/or time of the grind. Organic shingles are reinforced with a cellulose fiber mat (paper), which is saturated with 140 degree F. melt point asphalt. This is about 24 percent of the total shingle composition with 60 percent asphalt and 40 percent cellulose. Both the cellulose and the asphalt are very valuable. About ½ to 1 inch pieces are created as the top surfacing granules and asphalt coating is removed leaving only the saturated felt or glass fiber mat.

The saturated felt can be combined with diluents and mixed in a Cowels type mixer (vertical shaft with a horizontal blade attached to the bottom) or other mixer that creates shear. The "hot process" liquefies and "pulps" the mixture. During this process, the cellulose fibers are separated from the paper-like structure and survive as intact fibers.

Diluents are additives other than asphalt that can be introduced to the shingle mix since they are cost efficient, natural, and may be easily received from waste streams such as used fryer oil. The diluents may include various additives in order to produce the cold patch directly in the mixer. It has also been determined that Tall Oil is a useful diluent because it is a natural product (by-product of paper production from pine sap) and it reduces viscosity more effectively and cost efficiently than asphalt. Tall oil also promotes adhesion between aggregate and asphalt in roads. During the hot system, asphalt, waxes, oils, and other viscosity reducing diluents can be added to make the mixture pourable and to achieve desirable changes in properties. Waxes, hard asphalt, high penetration asphalt, or other solids can be added to the cold process.

The saturated felt pulp is important as a raw material for such things as paving, cold patch, crack filler roofing pour coat, paving tack coating, roof cement, laminating adhesive and many other asphalt based products. The 140 degree F. melting point is an important feature since all of the above products use a 100 degree F. melting point paving asphalt. Adding softer asphalts, oils, waxes, or other viscosity modifiers can easily bring this asphalt to the properties of paving flux.

The present invention asphalt has a relatively long shelf life since it is covered and protected by the surface granules and filled asphalt coating. UV contributes the most to the aging process; therefore, saturated felt component is well protected by this coating.

As a paving additive, the fibers are beneficial for reinforcement in order to prevent cracks and "rutting." Rutting can occur in hot weather and is caused by wheel weight concentrated in one area. A preferred use of the resulting material would be to use the material to manufacture crack filler for roads. However, other uses are contemplated and within the scope of the present invention, including, but not limited to, using the material for the production of roofing membranes.

With a low melting point and lack of filler contamination, it makes it possible to emulsify this material. This is a high shear process as water is combined with asphalt. It makes it suitable for use in roofing and road applications.

Additionally, this material can be stored in the standard, non-agitated tanks used by asphalt roofing and paving producers. By removing denser fillers, settling is not a problem.

The combination of the saturated felt component with biodiesel or fuel oil can be more easily burned by power plants, cement kilns, or other oil powered or coal powered plants. Whole shingles have been burned in these plants, but the granules and filler must be separated from the ash and disposed of. Both the asphalt and cellulose fiber are considered highly combustible.

Commercial low slope roofs can be made of layers of membrane adhered together with asphalt. Usually a roofer heats up kegs of asphalt in a kettle and pumps it to the roof surface. The saturated felt can be prepared this way and can be used for this purpose without modifying the existing equipment. The fiber content aids in the prevention of cracking of the pour coat.

A cold patch or pothole mix is composed of fuel oil, asphalt, adhesion enhancers and aggregate. The first three items are usually mixed in a tanker truck and delivered to a paving operation to be mixed with aggregate. Liquefied saturated felt is ideal for this application because the fibers add cohesive strength and the material stays in suspension in the truck. This entire cold patch mix, including the aggregate, can be produced in the horizontal mixer. Then, the finished product is typically shipped to a location where it is stored outside in a pile for use. This type of repair is used in the winter when hot paving is unavailable.

Most of the asphalt shingles used today are composed of two pieces laminated together. The lamination adhesive is composed of asphalt and rubber. This fiber assists in the recycling process by increasing cohesive strength and increasing the melting point. A successful laminating adhesive has been developed from the product of this process. Also, the presence of fiber allows for the production of molded parts. It allows for patio blacks, shaped shingles, road dividers, and other products to be manufactured.

Roofing producers may reuse granules from this process. The granules must be cleaned with a solvent or agitated in cold water in order to remove asphalt residue. Additionally, the granules may be introduced into the paving or cold patch without being cleaned, as the asphalt coating the granules becomes part of the asphalt component of the shingles. This becomes an important integration for roadways.

It has also been determined that adding an extremely high penetration (softness measurement) asphalt (300-400 pen) will rejuvenate the old shingles. Standard paving grade has a penetration value of about 100. The higher penetration value means that the asphalt is softer. Asphalt is composed of maltene and asphaltene fragments. As shingles age, parts of maltene fraction become asphaltenes whereby the shingles become more brittle. The high penetration asphalt has a very high proportion of maltenes; consequently, the shingle asphalt can be rebalanced and rejuvenated.

A separate device may be used to increase the production rate for the hot process of the horizontal mill. It is a second type of grinder that can handle bundles, post consumer scrap, and roofing plant scrap that is not in bundle form. This may also deal with roofing plant bundles. Essentially, this is a cement mixer along with a hot oil jacket. This embodiment has the advantage of allowing full bundles to be placed into the mixer along with plastic wrappers. Hot asphalt or other diluents may be added. Rotating in one direction allows this material to be mixed. Roof shingles are manufactured in a continuous process. Web breaks create scrap that is rolled up and placed on pallets. This embodiment of the present invention can handle these various forms of scrap and operates as a hot and cold process.

During the processing of post-consumer shingles, nail removal is very important. Some nails are loose and others are still in some of the shingle pieces. The nail/shingle entanglement presents a significant removal challenge. Magnets cannot be used because both the nail and the pieces of the shingle are attached. Non-ferris nails cannot be removed because of both the entanglement issue and the lack of attraction to magnets. The present invention has equipment that "pulps" the shingles so that nails are no longer attached. They can be easily removed with mechanical filters and magnets. This device works during hot, cold, or ambient temperatures.

The overall output of this system gets the shingles into a consistency where they can be further processed to reduce the granules. This secondary process could be a ball mill, attritor immersion mill, cone mill, ring mill, or the like such as disclosed in Applicant's U.S. Pat. No. 5,848,755 incorporated herein by reference. The hot slurry that is created is an ideal feed to a ball mill or the like, which reduces the granules to 200 mesh. Since a ball mill or attritor works best with a feed that is pre-reduced in size and preheated, the hot slurry is a preferred end material. The end material can be used in asphalt applications except for fiberglass based roofing materials. Some products, such as recoverboards, can this material as is, but other uses may require an additional step.

Modifications and substitutions by one of ordinary skill in the art are considered to be within the scope of the present invention, which is not to be limited except by the allowed claims and their legal equivalents.

The invention claimed is:

1. An asphalt shingle recycling system comprising:

a horizontal mixer including both a horizontal mixer heating means and a horizontal mixer cooling means, said horizontal mixer comprising a horizontal cylinder shaped body having an interior region and configured for processing asphalt based roofing shingle components having surface granules, said horizontal mixer including:

a horizontally oriented ribbon blender disposed in said interior region and affixed to a horizontal, motor driven shaft; and a plurality of high speed choppers, each of said plurality of high speed choppers including a motor coupled to a shaft to which is attached a "T" shaped head, said "T" shaped head of each of said plurality of high speed choppers disposed in said interior region of said horizontal mixer and having a flat impacting surface and a sharpened edge;

said horizontal mixer heating means disposed on an exterior surface of said horizontal cylinder shaped body, said horizontal mixer heating means configured for heating a plurality of asphalt based shingle components disposed in said interior region of said horizontal mixer at an elevated temperature of at least 140 F, and in cooperation with said horizontally oriented ribbon blender and said plurality of high speed choppers, for providing a hot asphalt based slurry from hot processed asphalt shingles; and said horizontal mixer cooling means disposed on said exterior surface of said horizontal cylinder shaped body, said horizontal mixer cooling means configured for cooling a plurality of asphalt based shingle components disposed in said interior region of said horizontal mixer at a temperature below ambient temperature, and in cooperation with said horizontally oriented ribbon blender and said plurality of high speed choppers, for providing a dry asphalt based powder and roofing shingle granules.

2. The horizontal mixer of claim 1, wherein said high speed choppers rotate at 3000 RPMs.

3. The horizontal mixer of claim 1, further including a component separation processing system, configured for separating the dry powder material of the cold processing system into surface granules, filled asphalt coating and a saturated felt component.

4. The horizontal mixer of claim 1, wherein said hot asphalt slurry is provided to a further processing device configured for accepting the hot slurry for further processing.

* * * * *